US007122511B2

(12) United States Patent
Borchers et al.

(10) Patent No.: US 7,122,511 B2
(45) **Date of Patent: *Oct. 17, 2006**

(54) PROCESS FOR THE PREPARATION OF BLEACH ACTIVATOR GRANULES

(75) Inventors: Georg Borchers, Bad Nauheim (DE); Torsten Pilz, Oberrcifenberg (DE)

(73) Assignee: Clariant GmbH, Frankfurt (DE)

( * ) Notice: Subject to any disclaimer, the term of this patent is extended or adjusted under 35 U.S.C. 154(b) by 574 days.

This patent is subject to a terminal disclaimer.

(21) Appl. No.: 10/201,459

(22) Filed: Jul. 23, 2002

(65) Prior Publication Data

US 2003/0045445 A1 Mar. 6, 2003

(30) Foreign Application Priority Data

Jul. 25, 2001 (DE) ..... 101 36 805

(51) Int. Cl.
*C11D 1/02* (2006.01)
*C11D 1/66* (2006.01)
*C11D 3/59* (2006.01)

(52) U.S. Cl. ..... 510/451; 510/311; 510/376

(58) Field of Classification Search ..... 510/311, 510/376, 451, 457

See application file for complete search history.

(56) References Cited

U.S. PATENT DOCUMENTS

| | | | | | |
|---|---|---|---|---|---|
| 3,822,114 | A | | 7/1974 | Montgomery | 8/111 |
| 4,290,903 | A | * | 9/1981 | Macgilp et al. | 252/91 |
| 5,318,733 | A | | 6/1994 | Carduck et al. | 264/15 |
| 5,334,324 | A | * | 8/1994 | Zeise et al. | 510/513 |
| 6,200,944 | B1 | * | 3/2001 | Dovey et al. | 510/313 |
| 2003/0040452 | A1 | | 2/2003 | Borchers et al. | 510/311 |

FOREIGN PATENT DOCUMENTS

| | | |
|---|---|---|
| DE | 41 43 016 | 7/1993 |
| EP | 0 446 982 | 9/1991 |
| EP | 0 458 397 | 11/1991 |
| EP | 0 458 398 | 11/1991 |
| EP | 0 486 592 | 5/1992 |
| EP | 1 275 709 | 1/2003 |
| WO | WO 92/02608 | 2/1992 |
| WO | WO 99/27061 | 6/1999 |

OTHER PUBLICATIONS

English abstract for DE 4143016, Jul. 1, 1993.

* cited by examiner

*Primary Examiner*—Michael Barr
*Assistant Examiner*—John M Petruncio
(74) *Attorney, Agent, or Firm*—Richard P. Silverman

(57) ABSTRACT

Process for the preparation of bleach activator granules, which comprises extruding a mixture comprising bleach activator, anionic or nonionic surfactant and polyalkylene glycol at temperatures of from 40 to 120° C. and a pressure of from 5 to 30 bar, and granulating the resultant extrudates at a temperature of from 40 to 120° C. on a spheronizer.

17 Claims, No Drawings

PROCESS FOR THE PREPARATION OF BLEACH ACTIVATOR GRANULES

The present invention relates to a process for the preparation of cylindrical to spherical extrudates which comprise bleach activators, have defined particle sizes and narrow particle size distribution and have low abrasion behavior and good flow behavior.

A large number of patent specifications disclose processes for the preparation of extruded laundry detergents and cleaners. EP 486 592 describes the preparation of extruded shaped bodies where a solid and flowable premix is compressed in the form of an extrudate using a plasticizer and/or lubricant using relatively high pressures between about 25 and 200 bar. The extrudate has a consistency such that, after it has emerged from the perforated die, it can be cut directly to predetermined granule dimension by means of a cutting device. The plasticizers and/or lubricants mentioned are, in particular, aqueous anionic surfactant pastes, aqueous polymer solutions and/or nonionic surfactants which are liquid at room temperature. The extruded molded bodies which can be prepared in this way generally have a size up to 2 cm, preferably up to 0.8 cm, where the length/diameter ratio is advantageously between 1:1 and 3:1.

As described in WO 99/27061, bleach activators are advantageously formulated in the form of cylindrical extrudates in order to ensure compatibility with other laundry detergent constituents and adequate storage stability. It is assumed that the highly reactive bleach activator is predominantly embedded in the inside of the cylindrical granule and the surface consists primarily of binding materials and plasticizer.

In order to avoid separation of the various particles in the laundry detergent formulation during transportation and storage, the particle diameter should be between 0.2 mm and 2 mm, preferably between 0.5 mm and 0.8 mm, and the particle length should be in the range from 0.5 mm to 3.5 mm, ideally between 0.9 mm and 2.5 mm.

All of the previously described processes for the preparation of extrudates produce either molded bodies with a relatively broad particle size distribution and/or a comparatively high dust fraction. The particles have sharp corners and edges at the cutting points; these cause high abrasion with the formation of dust and unfavorable flow behavior. If the preparation of the extrudates is carried out under high compressive forces, the dissolution behavior of the particles is significantly impaired.

The object of the invention was then to prepare cylindrical to spherical extrudates having a content of bleach activators for use in laundry detergents or cleaners which have a very narrow particle size distribution and at the same time exhibit a low abrasion tendency, low dust formation, favorable flow behavior and good dissolution behavior during the washing and cleaning operation.

The invention provides a process for the preparation of bleach activator granules, which comprises extruding a mixture comprising bleach activator, anionic or nonionic surfactant and polyalkylene glycol at temperatures of from 40 to 120° C., preferably 60 to 80° C., and a pressure of from 5 to 30 bar, and granulating the resultant extrudates at a temperature of from 40 to 120° C., preferably 60 to 80° C., on a spheronizer.

Examples of suitable bleach activators are N,N,N',N'-tetraacetylethylendiamine (TAED), Glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglycoluril (TAGU), tetraacetylcyanic acid (TACA), di-N-acetyldimethylglyoxime (ADMG), 1-phenyl-3-acetylhydantoin (PAH), nonanoylcaprolactam phenylsulfonate ester (APES), nitrilotriacetate (NTA), preferably the sodium salt of nonanoyloxybenzenesulphonate (NOBS), the sodium salt of 3,5,5-trimethylhexanoyloxyphenylsulfonate (iso-NOBS) or the sodium salt of acetoxyphenylsulfonate (ABS).

Preferred anionic surfactants are alkali metal salts, ammonium salts, amine salts and salts of amino alcohols from the following compounds: alkyl sulfates, alkyl ether sulfates, alkylamide sulfates and alkylamide ether sulfates, alkylaryl polyether sulfates, monoglyceride sulfates, alkylsulfonates, alkylamidosulfonates, alkylarylsulfonates, α-olefinsulfonates, alkylsulfosuccinates, alkyl ether sulfosuccinates, alkylamide sulfosuccinates, alkyl sulfoacetates, alkylpolyglyceryl carboxylates, alkyl phosphates, alkyl ether phosphates, alkyl sarcosinates, alkyl polypeptidates, alkyl amidopolypeptidates, alkyl isethionates, alkyl taurates, alkyl polyglycol ether carboxylic acids, or fatty acids, such as oleic acid, ricinoleic acid, palmitic acid, stearic acid, copra oil acid salt or hydrogenated copra oil acid salts. The alkyl radical in all of these compounds normally contains 8–32, preferably 8–22, carbon atoms. Particular preference is given to linear straight-chain alkylbenzenesulfonates, in particular with a $C_8$–$C_{20}$-, particularly preferably with a $C_{11-13}$-alkyl group.

Preferred nonionic surfactants are polyethoxylated, polypropoxylated or polyglycerolated ethers of fatty alcohols, polyethoxylated, polypropoxylated and polyglycerolated fatty acid esters, polyethoxylated esters of fatty acids and of sorbitol, polyethoxylated or polyglycerolated fatty amides.

Suitable polyalkylene glycols are polyethylene glycols, 1,2-polypropylene glycols, and modified polyethylene glycols and polypropylene glycols. The modified polyalkylene glycols include, in particular, sulfates and/or disulfates of polyethylene glycols or polypropylene glycols with a relative molecular mass between 600 and 12 000, and in particular between 1 000 and 4 000. A further group consists of mono- and/or disuccinates of the polyalkylene glycols, which again have relative molecular masses between 600 and 6 000, preferably between 1 000 and 4 000. In addition, ethoxylated derivatives such as trimethylolpropane with 5 to 30 EO are also included.

The preferred polyethylene glycols used may have a linear or branched structure, preference being given in particular to linear polyethylene glycols. Particularly preferred polyethylene glycols include those with relative molecular masses between 2 000 and 12 000, advantageously around 4 000, where polyethylene glycols with relative molecular masses below 3 500 and above 5 000 can in particular be used in combination with polyethylene glycols with relative molecular mass around 4 000, and such combinations advantageously have more than 50% by weight, based on the total amount of the polyethylene glycols, of polyethylene glycols with a relative molecular mass between 3 500 and 5 000.

The modified polyethylene glycols also include polyethylene glycols which are terminally capped on one or more sides, where the end-groups are preferably $C_1$–$C_{12}$-alkyl chains, preferably $C_1$–$C_6$, which may be linear or branched. Polyethylene glycol derivatives terminally capped on one side can also conform to the formula Cx(EO)y(PO)z, where Cx may be an alkyl chain with a carbon chain length of from 1 to 20, y may be 50 to 500 and z may be 0 to 20.

Also suitable are low molecular weight polyvinylpyrrolidones and derivatives of these with relative molecular masses up to at most 30 000. Preference is given in this connection to relative molecular mass ranges between 3 000 and 30 000. Polyvinyl alcohols are preferably used in combination with polyethylene glycols.

To improve the plasticizing and lubricant properties, but also the abrasion resistance of the bleach activator granules, it is also possible to add one or more components which are liquid at room temperature or are in the form of a melt under the processing conditions, for example linear or branched fatty acids, in particular nonanoic acid or ethoxylated fatty acids with 2 to 100 EO.

The above described mixture of all components can additionally comprise small amounts of a solvent, preferably less than 15% by weight, preferably less than 10% by weight, particularly preferably less than 7% by weight. A preferred solvent is water.

Further suitable additives are substances which influence the pH during storage and use. These include organic carboxylic acids or salts thereof, such as citric acid in anhydrous or hydrated form, glycolic acid, succinic acid, maleic acid or lactic acid. Also possible are additives which influence the bleaching power, such as complexing agents and transition metal complexes, e.g. iron-, cobalt- or manganese-containing metal complexes, as described in EP-A-0 458 397 and EP-A-0 458 398.

Particularly advantageous embodiments of the invention comprise, as bleach activator, the sodium salt of nonanoyloxyphenylsulphonate (NOBS), as solubility promoter, linear straight-chain alkylbenzenesulfonates, in particular with a $C_8$–$C_{20}$-, particularly preferably with a $C_{11-13}$-alkyl group (LAS), and nonanoic acid and polyethylene glycol (PEG) 4000 as bodying agent and plasticizer, where the proportion of NOBS is 70% by weight to 90% by weight, preferably 80% by weight to 87% by weight, particularly preferably 81% by weight to 85% by weight, that of LAS is 2% by weight to 10% by weight, preferably 3% by weight to 5% by weight, particularly preferably 3.7% by weight to 4.5% by weight, that of nonanoic acid is 0.1% by weight to 6% by weight, preferably 1% by weight to 4% by weight, particularly preferably 2,5% by weight to 3,5% by weight, that of PEG 4000 is 1% by weight to 15% by weight, preferably 5% by weight to 10% by weight, particularly preferably 7% by weight to 8% by weight.

Advantageously, bleach activator, for example nonanoyloxyphenylsulphonate (NOBS) and anionic or nonionic surfactant, for example alkylbenzenesulfonate (LAS), are mixed in the form of a powder, plasticizer, for example nonanoic acid and PEG 4000, are introduced at 50 to 70° C., preferably 60 to 65° C., and the mixture is compressed into extrudates at a temperature in the range from 60 to 70° C. and a pressure from 14 bar to 22 bar. In a preferred embodiment of the invention, the mixture is introduced continuously into a single-shaft extruder, twin-shaft extruder or twin-screw extruder with cocurrent or countercurrent screw control, the housing of which and the extruder granulator head of which can be heated to the predetermined extrusion temperature. Under the shear action of the extruder screws, the mixture is compressed, plasticized, extruded in the form of extrudates through the perforated die plate in the extruder head, where necessary powdered with finely particulate anticaking agent, for example $TiO_2$, silica, zeolite, its own dust, comminuted into coarse straw sections and transferred to a spheronizer heated to 40 to 120° C., preferably 60 to 80° C., in particular 60 to 65° C.

The subsequent spheronizing process gives cylindrical to spherical granules with defined particle sizes and very narrow particle size distribution, where the particle diameter is between 0.2 mm and 2 mm, preferably between 0.5 mm and 0.8 mm, and the length of the particle is in the range from 0.5 mm to 3.5 mm, ideally between 0.9 mm and 2.5 mm. The extrudates are placed directly onto the spheronizer or are optionally coarsely precomminuted. In a preferred embodiment, the shaping process according to the invention is carried out continuously in a cascade operation, although a batchwise operation is also possible.

The size and shape of the particles can be influenced and brought about in the spheronizing process by a number of parameters. The shaping process is determined by the fill level, the temperature of the mixture, the residence time of the mixture in the spheronizer, by the rotational speed of the spheronization disc, and by the plastic deformability of the mixture.

As the fill level in the spheronizer decreases, shorter cylinder granules and a narrower particle size distribution are obtained. As the temperature decreases and the plasticity becomes less, longer granules are obtained, and upon further cooling, the dust fraction increases greatly.

The residence time of the mixture in the spheronizer depends not only on the plasticity but also on the fill level and is preferably 10 sec to 120 sec, particularly preferably 20 sec to 60 sec, and the peripheral speed is 10 m/sec to 30 m/sec, preferably 12 m/sec to 20 m/sec.

In a particular embodiment, the temperature in the spheronizer is controlled by introducing a stream of air or gas ($N_2$), preferably via the flushing air gap. The temperature of the air or gas streams is 50 to 120° C., preferably 60 to 90° C., so that, after the spheronizing has taken place in each case, the desired operating temperature in the spheronizer can be maintained.

After the shaping process, the cylindrically shaped and rounded particles are cooled in a downstream apparatus, preferably in a fluidized-bed cooler in a stream of cold air or gas, to temperatures below 40° C. in order to prevent the granules sticking together.

The granules obtained in this way are characterized by favorable flow behavior, low dust fraction and high abrasion resistance.

The bulk density is in the range 300 g/l to 2 000 g/l, preferably in the range 400 g/l to 1 500 g/l, and particularly preferably in the range 500–800 g/l.

The granules obtained according to the invention are suitable for direct use in laundry detergents and cleaners. They can optionally be provided with a coating shell.

Further possible additives are substances which, in the wash liquor, react with the peroxycarboxylic acid released from the activator to form reactive intermediates, such as dioxiranes or oxaziridines, and, in so doing, can increase the reactivity. Suitable compounds are ketones and sulfonimines according to U.S. Pat. No. 3,822,114 and EP-A-O 446 982.

The amount of additive is governed in particular by its nature. Thus, acidifying additives and organic catalysts are added to increase the performance of the peracid in amounts of from 0 to 20% by weight, in particular in amounts of from 1 to 10% by weight, based on the total weight, whereas metal complexes are added in concentrations in the ppm range.

The resultant granules are characterized by very high abrasion resistance and storage stability in pulverulent laundry detergent, cleaner and disinfectant formulations. They are ideal for use in heavy-duty laundry detergents, stain removal salts, machine dishwashing detergents, pulverulent all-purpose cleaners and denture cleaners.

In these formulations, the granules according to the invention are in most cases used in combination with a hydrogen peroxide source. Examples thereof are perborate monohydrate, perborate tetrahydrate, percarbonates, and hydrogen peroxide adducts with urea or amine oxides. In addition, the formulation can, corresponding to the prior art, have further laundry detergent constituents, such as organic and inorganic builders and cobuilders, surfactants, enzymes, brighteners and perfume.

The examples below serve to illustrate the invention in more detail without limiting it thereto.

EXAMPLE 1

Preparation of NOBS Granules, Active Ingredient Content: 84.4% by weight

| | |
|---|---|
| granule diameter d: | 0.7 mm |
| granule length l: | 1.4 mm |

844 g of the sodium salt of nonanoyloxybenzenesulfonate (NOBS), 50 g of linear $C_{11-13}$-alkylbenzenesulfonate, Na salt, 31 g of nonanoic acid and 75 g of polyethylene glycol 4000 are homogeneously mixed in a plowshare mixer (manufacturer Lödige) at room temperature at a speed of 120 revolutions per minute and with a connected knife head over a period of 150 seconds, heated to 65 to 71° C., transferred to a single-shaft dome extruder (manufacturer Fitzpatrick) with a bore diameter of 0.7 mm in the perforated die, and extruded at an extruder screw speed of 45 revolutions per minute, and a throughput of 287 g/min. 500 g of extrudates are then converted to the pregiven particle shape at a temperature of from 65 to 69° C. in a batch spheronizer (manufacturer Schlüter) with a diameter of 0.3 m at a speed of 1 000 revolutions per minute, a peripheral speed of 15.71 m/sec and a residence time of 40 seconds. After the shaping process, the cylindrically shaped and rounded particles are cooled in a downstream apparatus, preferably in a fluidized-bed cooler in a stream of cold air, in order to prevent the granules from sticking together. 94.9% of the resultant granules correspond to the target size of d=0.7 mm and a mean length of $I_{50}$=1.37 mm. The breadth of the length distribution is in the range from $I_{10}$=1.03 mm to $I_{90}$=1.66 mm. 5.05% fines content and 0.05% coarse content are screened off, and the screened target fraction has a bulk density of 692 g/l.

EXAMPLE 2

Preparation of NOBS Granules, Active Ingredient Content: 85.8% by weight

| | |
|---|---|
| granule diameter d: | 0.7 mm |
| granule length l: | 1.4 mm |

858 g of the sodium salt of nonanoyloxybenzenesulphonate (NOBS), 42 g of linear $C_{11-13}$-alkylbenzenesulfonate, Na salt, 29 g of nonanoic acid and 71 g of polyethylene glycol 4000 are homogeneously mixed in a plowshare mixer (manufacturer Lödige) at room temperature at a speed of 120 revolutions per minute and with a connected knife head over a period of 150 seconds, heated to 62 to 65° C., transferred to a single-shaft dome extruder (manufacturer Fitzpatrick) with a bore diameter of 0.7 mm in the perforated die, and extruded at an extruder screw speed of 45 revolutions per minute, and a throughput of 199 g/min. 1 kg of extrudates are then converted to the pregiven particle shape at a temperature of from 60 to 62° C. in a batch spheronizer (manufacturer Schlüter) with a diameter of 0.3 m at a speed of 1 000 revolutuions per minute, a peripheral speed of 15.71 m/sec and a residence time of 40 seconds. After the shaping process, the cylindrically shaped and rounded particles are cooled in a downstream apparatus, preferably in a fluidized-bed cooler in a stream of cold air, in order to prevent the granules from sticking together. 97.37% of the resultant granules correspond to the target size of d=0.7 mm and $I_{50}$=1.45 mm. The breadth of the length distribution is in the range from $I_{10}$=1.03 mm to $I_{90}$=1.93 mm. 2.46% fines content and 0.17% coarse content are screened off, and the screened target fraction has a bulk density of 686 g/l.

EXAMPLE 3

Preparation of TAED Granules,

| | |
|---|---|
| granule diameter d: | 0.7 mm |
| granule length l: | 1.4 mm |

675 g of tetraacetylethylenediamine (TAED) and 100.9 g of fatty alcohol polyglycol ether $C_{16}$–$C_{18}$ were homogeneously mixed in a plowshare mixer (manufacturer Lödige) at room temperature at a speed of 120 revolutions per minute and with a connected knife head over a period of 150 seconds, heated to 65–68° C., transferred to a single-shaft dome extruder (manufacturer Fitzpatrick) with a bore diameter of 0.7 mm in the perforated die and extruded at an extruder screw speed of 45 revolutions per minute and a throughput of 199 g/min. 500 g of these extrudates were then converted to the particle shape given above at a temperature of 65–69° C. in a batch spheronizer (manufacturer Schlüter) with a diameter of 0.3 m at a speed of 1 000 revolutions per minute, a peripheral speed of 22.3 m/sec and a residence time of 40 seconds. After the shaping process, the cylindrically shaped and rounded particles were cooled in a downstream apparatus, preferably in a fluidized-bed dryer, in order to prevent the granules from sticking together. 93.6% of the resultant granules correspond to the target size of d=0.7 mm and $I_{50}$=1.45 mm. The breadth of the length distribution is in the range from $I_{10}$=0.91 mm to $I_{90}$=1.94 mm. 6.3% of fines content and 0.1% coarse content are screened off, and the screened target fraction has a bulk density of 699 g/l.

What is claimed is:

1. A process for the preparation of bleach activator granules, which comprises extruding a mixture comprising bleach activator, anionic or nonionic surfactant and polyalkylene glycol at an extrusion temperatures of from 40 to 120° C. and a pressure of from 5 to 30 bar, and granulating the resultant extrudates in a spheronizing step at a spheronizer temperature of from 40 to 120° C. on a spheronizer to form spherical granules.

2. The process as claimed in claim 1, wherein the mixture further comprises linear or branched fatty acids or ethoxylated fatty acids having 2 to 100 EO.

3. The process as claimed in claim 1, wherein the anionic surfactant comprises an alkylarylsulfonate.

4. The process as claimed in claim 1, wherein the polyalkylene glycol comprises polyethylene glycol.

5. The process as claimed in claim 1, wherein the bleach activator comprises Na nonanoyloxybenzenesulfonate.

6. The process as claimed in claim 1, wherein the spherical granules are comprise 70 to 90% by weight of Na nonanoyloxybenzenesulfonate, 2 to 10% by weight of alkylbenzenesulfonate, 0.1 to 6% by weight of nonanoic acid and 1 to 15% by weight of polyethylene glycol 4000.

7. The process as claimed an claim 1, wherein the extrudates are placed directly on the spheronizer or are coarsely precomminuted prior to the spheronizing step.

8. The process as claimed an claim 1, wherein the spheronizer temperature in the spheronizer is controlled by introducing a stream of air or gas into the spheronizer.

9. The process as claimed in claim 1, wherein the spheronizer operates at a peripheral speed of from 10 to 30 m/sec.

10. The process as claimed in claim 1, wherein the residence time in the spheronizer is from 10 to 120 sec.

11. The process as claimed in claim 1, wherein the spheronizing step is carried out batchwise or continuously in a cascade operation.

12. The process as claimed in claim 1, further comprising powdering the extrudates with an anticaking agent.

13. The process as claimed in claim 1, further comprising cooling the extrudates to temperatures of <40° C. after the spheronizing step.

14. The process as claimed in claim 13, wherein cooling is carried out by contacting the extrudates with cooling gas or cooled surfaces.

15. The process as claimed in claim 13, wherein cooling is carried out in a separate downstream apparatus or, in the case of spheronizers operating in a batchwise manner, directly in the spheronizer.

16. The process of claim 1, wherein the spherical granules comprise a bulk density of from 300 g/l to 2,000 g/l.

17. The process of claim 1, wherein the extrusion temperature and the spheronizer temperature range from 60 to 80° C.

* * * * *